US008370989B2

(12) United States Patent
Chang et al.

(10) Patent No.: US 8,370,989 B2
(45) Date of Patent: Feb. 12, 2013

(54) STATIC ELIMINATOR WITH DUST REMOVAL FEATURE

(75) Inventors: Chi-hsing Chang, Tu Cheng (TW); Feng-chi Lee, Tu Cheng (TW); Kuo-chuan Chiu, Tu Cheng (TW)

(73) Assignee: Cheng Uei Precision Industry Co., Ltd., Tu Cheng, Taipei (TW)

( * ) Notice: Subject to any disclaimer, the term of this patent is extended or adjusted under 35 U.S.C. 154(b) by 349 days.

(21) Appl. No.: 12/848,170

(22) Filed: Jul. 31, 2010

(65) Prior Publication Data

US 2012/0023688 A1 Feb. 2, 2012

(51) Int. Cl.
*F23J 1/00* (2006.01)

(52) U.S. Cl. ..... 15/301; 15/1.51; 15/306.1; 15/393; 15/394

(58) Field of Classification Search ..... 15/301, 15/303, 304, 306.1, 308, 393, 394, 105, 1.51; 96/16, 17; *A47L 9/02*
See application file for complete search history.

(56) References Cited

U.S. PATENT DOCUMENTS

| | | | | |
|---|---|---|---|---|
| 5,351,354 | A * | 10/1994 | Hasumi et al. | 15/1.51 |
| 5,606,767 | A * | 3/1997 | Crlenjak et al. | 15/301 |
| 7,174,593 | B2 * | 2/2007 | Soejima et al. | 15/1.51 |
| 7,296,323 | B2 * | 11/2007 | Hayama et al. | 15/339 |
| 2003/0037400 | A1 * | 2/2003 | Hunter et al. | 15/306.1 |
| 2005/0000054 | A1 * | 1/2005 | Ninomiya et al. | 15/347 |
| 2006/0176642 | A1 * | 8/2006 | George et al. | 361/220 |
| 2009/0158537 | A1 * | 6/2009 | Ishijima et al. | 15/1.51 |
| 2010/0088830 | A1 * | 4/2010 | Takayanagi | 15/1.51 |

* cited by examiner

*Primary Examiner* — Basil Katcheves
*Assistant Examiner* — Beth Stephan
(74) *Attorney, Agent, or Firm* — Cheng-Ju Chiang

(57) ABSTRACT

Provided is a static eliminator with dust removal feature. The static eliminator includes an ion generator, a dust-removing main body and a dust-collecting device. The dust-removing main body has a workpiece-passing channel passing through the dust-removing main body. A dust-scraping member is disposed on a sidewall of the workpiece-passing channel. A blow vent of the ion generator communicates with said workpiece-passing channel and faces to the dust-scraping member. An inlet end of the dust-collecting device communicates with the workpiece-passing channel.

6 Claims, 5 Drawing Sheets

STATIC ELIMINATOR WITH DUST REMOVAL FEATURE

BACKGROUND OF THE INVENTION

1. Field of the Invention

The present invention relates to a static eliminator with dust removal feature, and more particularly to a static eliminator with dust removal feature for cleaning the dust on the workpiece surfaces and eliminating the static electricity thereof before the workpieces being mounted or assembled.

2. Description of the Prior Art

At present, with the development of science and technology, many products such as connectors are becoming thinner, lighter and smaller so assembly requirements for workpieces have become higher and higher.

One requirement for the workpieces is removing flash formed on the workpieces or swarfs dropped thereon. As we all know, because the friction between the workpieces and other objects can generate static electricity during insert-molding, transportation and so on, surfaces of each workpiece may adsorb a lot of dusts. If the dusts and the swarfs adsorbed on the workpiece surfaces are not effectively cleaned, they will make the workpiece surfaces by surface treatment be uneven and make the adhesive force between the spraying material and the workpiece surfaces be weak. Moreover, the dusts and the swarfs adsorbed on the workpiece surfaces maybe affect product functions. Therefore, it is important to clean the workpiece surfaces before assembling the workpiece with other components.

In order to effectively clean the dusts or the swarfs adsorbed on the workpiece surfaces, the prior dust removal method is employing a static fan, which could provide an amount of airflow having positive or negative electric charges to blow the dusts or the swarfs off and neutralize the static electricity on the workpiece surfaces. If the electric charges on the workpiece surfaces are negative, they can attract the positive electric charges of the airflow to neutralize the static electricity on the workpiece surfaces. If the electric charges on the workpiece surfaces are positive, they can attract the negative electric charges of the airflow neutralize the static electricity on the workpiece surfaces. Whereby the prior method can obtain the purpose of eliminating the static electricity. At the same time, the dusts adsorbed on the workpiece surfaces can be blown off by the airflow of the static fan thereby obtaining the purpose of cleaning the workpiece surfaces.

However, above prior dust removal method still cannot effectively clean the stubborn dusts on the workpiece surfaces. And the dusts, which are blown off and flying in the air, maybe cause our surroundings to be polluted and maybe float down on the workpiece surfaces again, thus reducing the cleaning effect.

In view of above described problems, it is desired to develop a static eliminator with dust removal feature that overcomes these problems.

BRIEF SUMMARY OF THE INVENTION

An object of the present invention is to provide a static eliminator with dust removal feature, which is capable of eliminating the static electricity of workpiece surfaces, really removing the stubborn dusts thereon, and collecting the removed foreign matters such as the dusts to prevent them from polluting the workpieces again.

To achieve the above object, in accordance with the present invention, a static eliminator with dust removal feature is provided, comprising an ion generator, a dust-removing main body and a dust-collecting device. The dust-removing main body has a workpiece-passing channel passing through the dust-removing main body. A dust-scraping member is disposed on a sidewall of the workpiece-passing channel. A blow vent of the ion generator communicates with said workpiece-passing channel and faces to the dust-scraping member. An inlet end of the dust-collecting device communicates with the workpiece-passing channel.

Based on the above description, a static eliminator with dust removal feature as provided by the present invention not only can eliminate the static electricity of workpiece surfaces, but also can completely delete the stubborn dusts thereon. Moreover, the present static eliminator also can collect the removed foreign matters such as the dusts to prevent them from polluting the workpieces again. In this way, the problem that the dusts flying in the air pollute the air and make the workpieces dirty again is completely overcome.

DETAILED DESCRIPTION OF THE PREFERRED EMBODIMENTS

Figure 1:
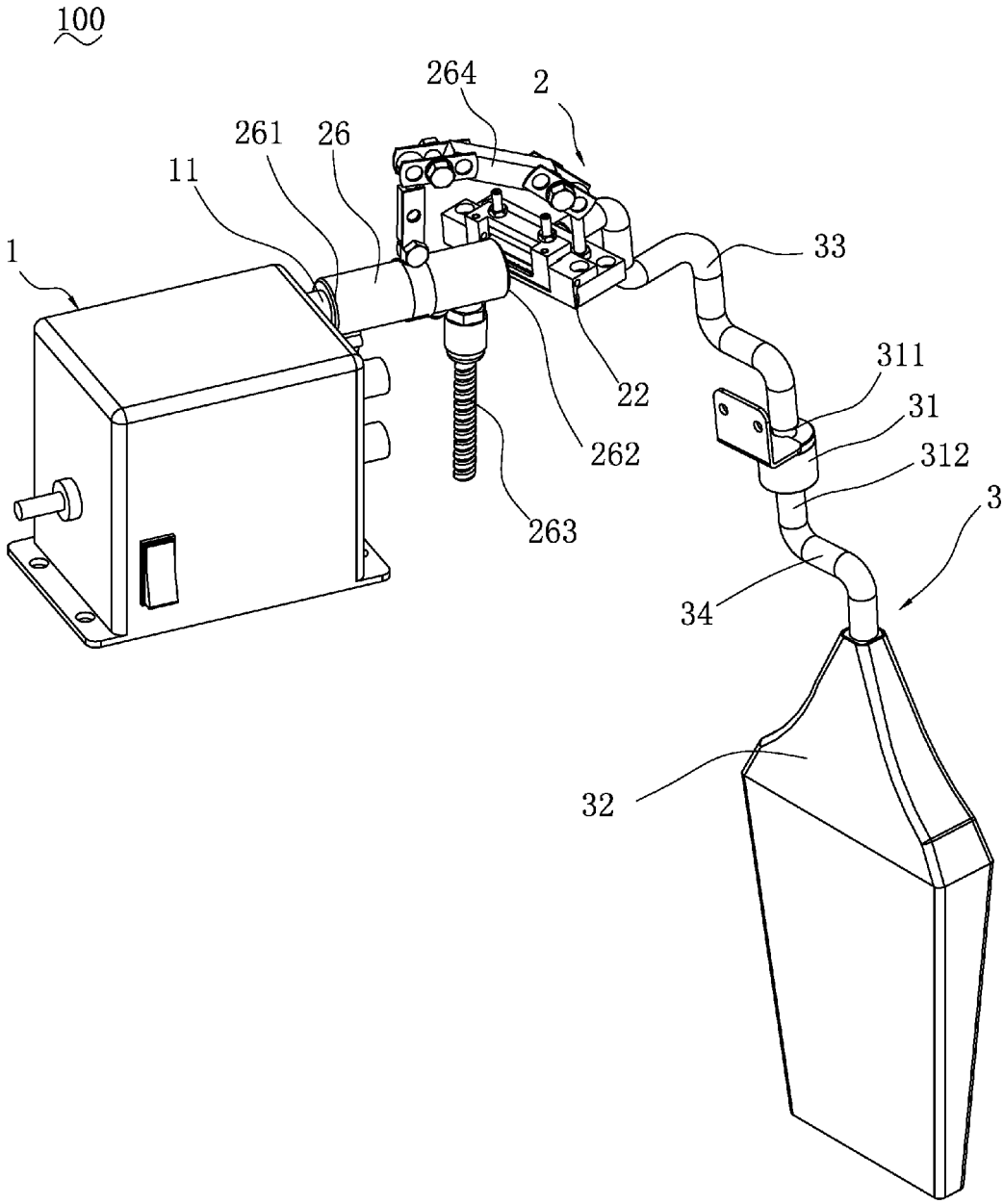
FIG. 1 is a perspective view illustrating a static eliminator with dust removal feature according to one embodiment of the present invention.

The following embodiment with reference to the accompanying drawings now has been given for detail describing the technology, the feature, the object and the effect of the present invention Please refer to FIG. 1, a static eliminator 100 with dust removal feature comprises an ion generator 1, a dust-removing main body 2 and a dust-collecting device 3 according to an embodiment of the present invention.

Figure 2:
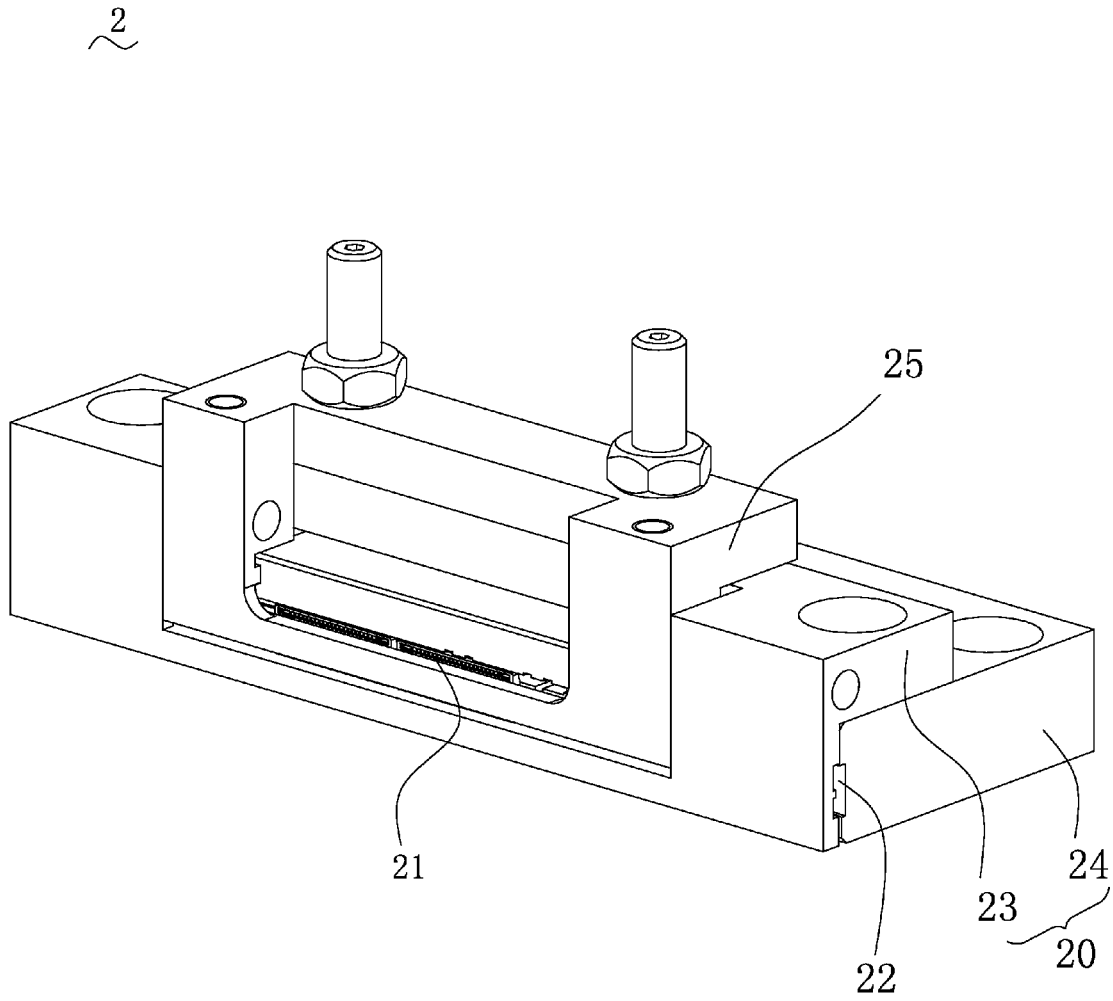
FIG. 2 is a perspective view showing a dust-removing main body of the static eliminator of FIG. 1.
Figure 3:
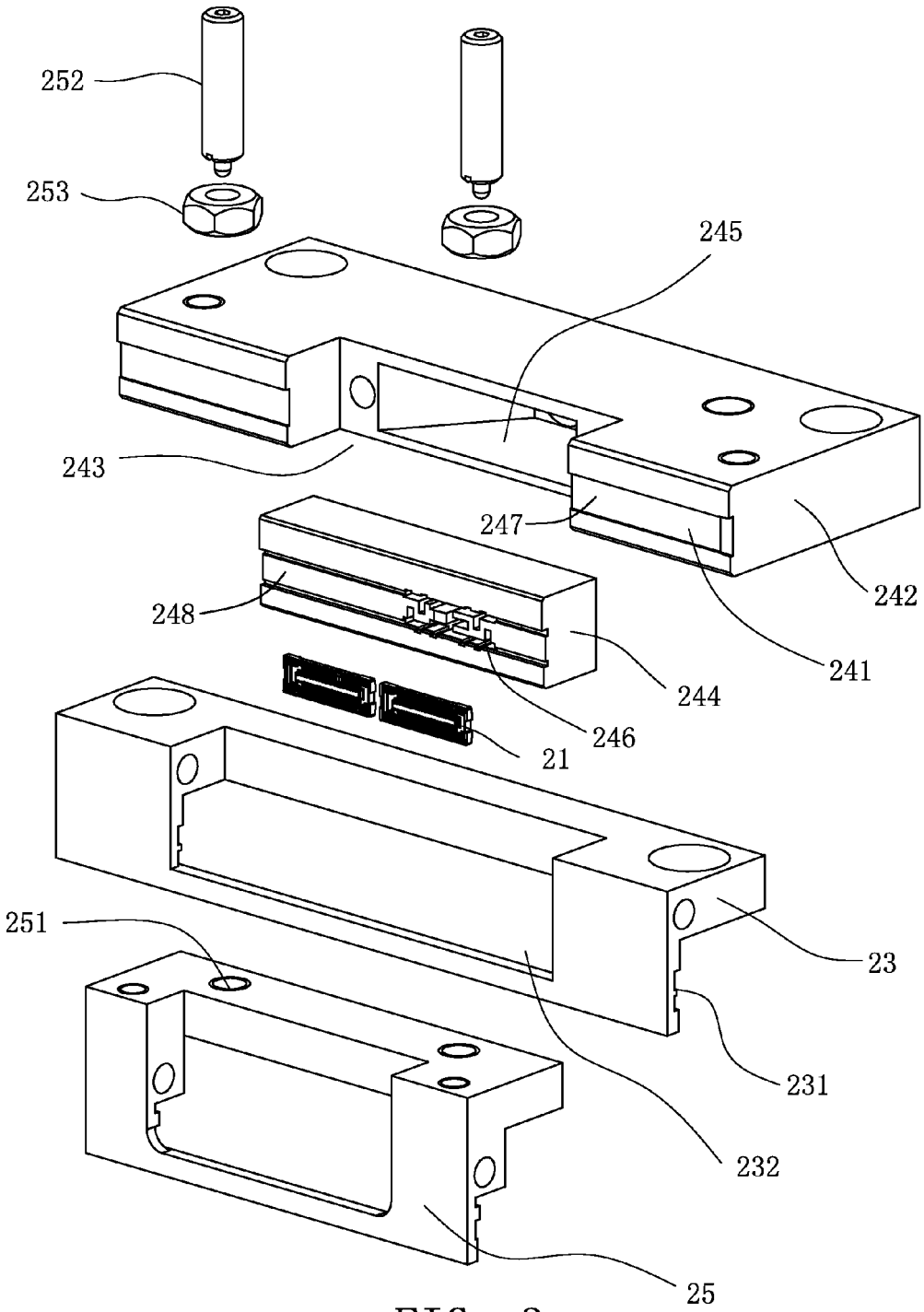
FIG. 3 is a exploded view of the dust-removing main body of FIG. 2.
Figure 4:
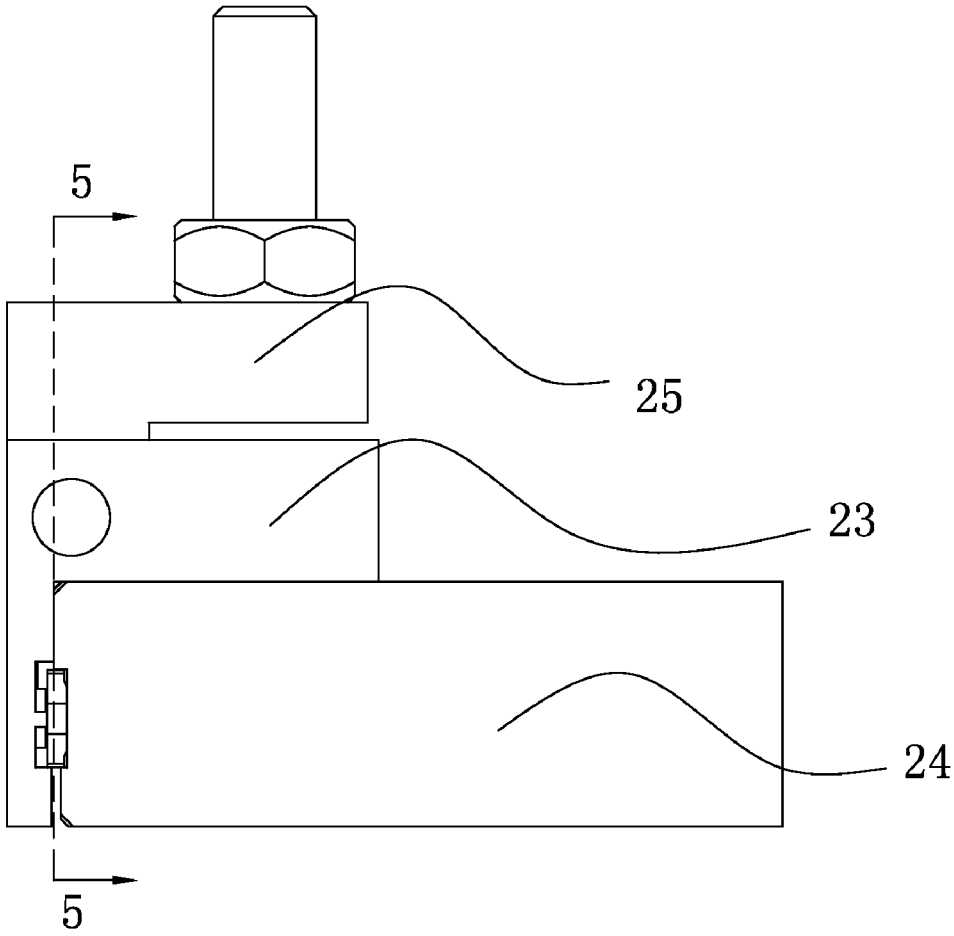
FIG. 4 is a side view of the dust-removing main body of FIG. 3.

Referring to FIGS. 2, 3 and 4, the dust-removing main body 2 comprises a base 20 and a holder seat 25. The base 20 comprises a front base 23 with a front sliding groove 231 formed on one sidewall thereof, and a rear base 24 having a rear sliding groove 241 formed on one sidewall thereof. When the front base 23 and the rear base 24 being assembled together, the front sliding groove 231 and the rear sliding groove 241 define a workpiece-passing channel 22 passing through the dust-removing main body 2. Workpieces waiting processed can enter into the inner of the dust-removing main body 2 by the workpiece-passing channel 22, thereby enabling them to be performed the cleaning processes such as cleaning dusts or eliminating the static electricity. Finally, workpieces already processed also can leave from the dust-removing main body 2 by the workpiece-passing channel 22.

Figure 5:
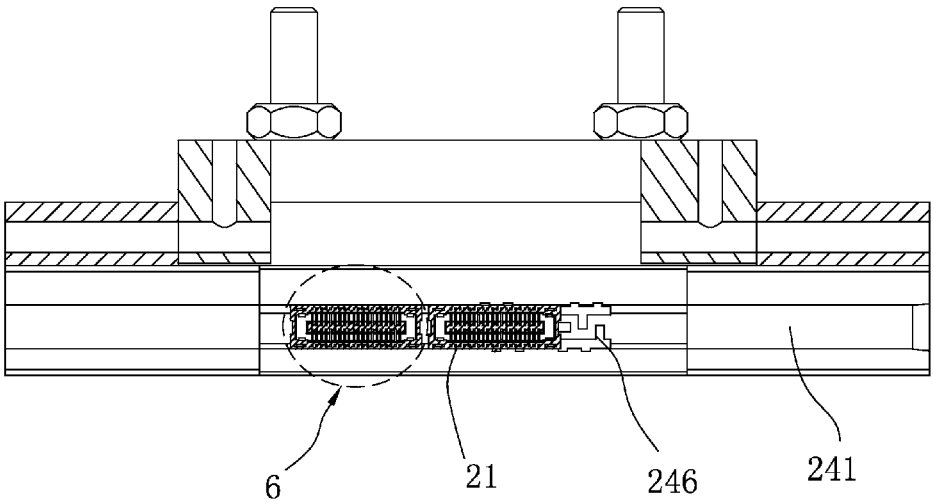
FIG. 5 is a sectional view along the A-A line in FIG. 4.
Figure 6:
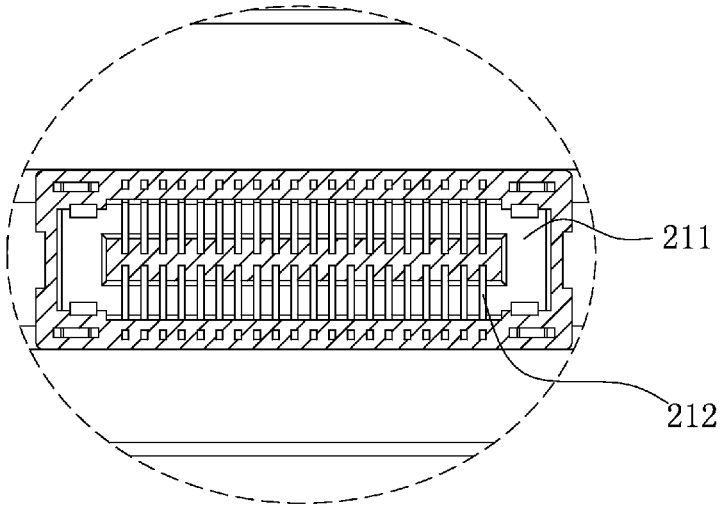
FIG. 6 is an enlarged view of part B of FIG. 5.

Referring to FIGS. 3, 5 and 6, the rear base 24 of the dust-removing main body 2 comprises a rear base housing 242 and a supporting part 244. The rear base housing 242 has a receiving space 243 defined the middle thereof for receiving the supporting part 244. Two sliding grooves 247 and 248 are separately formed on the sidewalls of the rear base housing 242 and the supporting part 244 and are capable of constituting the rear sliding groove 241. At least one dust-scraping member 21 is replaceable fixed on the sliding groove 248 of the supporting part 244 and can be replaced as other dust-scraping members having different styles according to the shape of the workpiece waiting processed. Generally, the dust-scraping member 21 with a slice shape has a concave portion 211 corresponding to the workpiece waiting processed and a number of slots 212 passing through the concave portion 211. Several rear holes 246 are formed on the sliding groove 248 of the supporting part 244 and are aligned with the slots 212 of the dust-scraping member 21 along the front-rear direction for communicating with each other. Moreover, the rear base housing 242 of the dust-removing main body 2 forms a dust-collecting cavity 245 facing the receiving space 243. The front base 23 of the dust-removing main body 2 still has a front opening 232 corresponding to the dust-scraping member 21. Namely, the slots 212 of the dust-scraping member 21 are located between the front opening 232 and the rear holes 246 in face to face. Therefore, the outer airflow of the dust-removing main body 2 can enter into the workpiece-passing channel 22 by the front opening 232 of the front base 23, pass through the slots 122 of the dust-scraping member 21, the rear holes 246 of the supporting part 244 and the dust-collecting cavity 245 of the rear base 24, and finally flow out of the dust-removing main body 2. Moreover, the holder seat 25 forms two screw holes 251 for being fixed on the base 20 of the dust-removing main body 2 by screws 252 and nuts 253 thereby making each component of the dust-removing main body 2 securely assemble together.

As shown in FIGS. 1 and 3, the static eliminator 100 with dust removal feature according to the embodiment of the present invention still comprises at least one ion-transmitting pipe 26 having an inlet end 261 connected to a blow vent 11 of the ion generator 1 and an exit end 262 facing to the front opening 232 of the dust-removing main body 2. Namely, the exit end 262 of the ion-transmitting pipe 26 faces to the dust-scraping member 21 so that the negative ions generated by the ion generator 1 can be blown into the workpiece-passing channel 22 of the dust-removing main body 2 by the front opening 232 for eliminating the static electricity of the workpiece waiting processed. Furthermore, the ion-transmitting pipe 26 is movable connected with the dust-removing main body 2 by a joint arm 264, which can be moved for adjusting the location of the dust-removing main body 2 and making the dust-scraping member 21 face to the exit end 262 of the ion-transmitting pipe 26. A supporting member 263 is disposed on the below of the ion-transmitting pipe 26 to support and fasten the ion-transmitting pipe 26.

The dust-collecting device 3 comprises a vacuum generator 31 capable of generating vacuum and a dust-collecting pocket 32. The vacuum generator 31 has an inlet end 311 connected with the dust-collecting cavity 245 of the dust-removing main body 2 by a dust-transmitting pipe 33 and an exit end 312 connected with the dust-collecting pocket 32 by another dust-transmitting pipe 34. Namely, the inlet end 311 of the vacuum generator 31 is connected with the workpiece-passing channel 22 of the dust-removing main body 2 and face to the dust-scraping member 21 by the dust-transmitting pipe 33.

Please refer to FIGS. 1 and 3 for detail describing the work process of the static eliminator 100 with dust removal feature. Firstly, when the workpiece is placed into the inner of the dust-removing main body 2 from one end of the workpiece-passing channel 22, and the workpiece automatically moves in the workpiece-passing channel 22 to contact with the dust-scraping member 21 located on the workpiece-passing channel 22, the dust-scraping member 21 can scrap the flash formed on the workpiece surfaces by the friction between the dust-scraping member 21 and the workpiece. At the same time, the negative ions generated by the ion generator 1 can pass through the ion-transmitting pipe 26 and the front opening 232 of the dust-removing main body 2, and enter into the workpiece-passing channel 22 to neutralize the ions on the workpiece surfaces thereby eliminating the static electricity on the workpiece surfaces. The swarfs, which are adsorbed on the workpiece surfaces because of the function of the static electricity, can be blown off. Then, these foreign matters such as the swarfs falling off the workpiece surfaces can successively pass through the slots 212 of the dust-scraping member 21, the rear holes 246 of the supporting part 244 and the dust-collecting cavity 245 of the rear base 24 thereby leaving the dust-removing main body 2 and being finally collected into the dust-collecting pocket 32 through the dust-transmitting pipes 33 and 34. The workpiece 22 already cleaned can be taken out from the workpiece-passing channel 22 for being assembled with other components.

In conclusion, the static eliminator 100 with dust removal feature as provided by the present invention not only can eliminate the static electricity of workpiece surfaces, but also can completely delete the stubborn dusts thereon. Moreover, the present static eliminator 100 also can collect the removed foreign matters such as the dusts to prevent them from polluting the workpieces again. In this way, the workpiece surfaces can be effectively cleaned before being mounted or assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A static eliminator with dust removal feature comprising:

a dust-removing main body, comprising a base, said base comprising a front base with a front sliding groove formed thereon and a rear base with a rear sliding groove formed thereon, the front base and the rear base being assembled together, the front sliding groove and the rear sliding groove commonly defining a workpiece-passing channel, wherein a dust-scraping member is fixed on the middle of a sidewall of the workpiece-passing channel;

an ion generator, having a blow vent that communicates with said workpiece-passing channel and is aligned with the dust-scraping member; and a dust-collecting device, having an inlet end that communicates with said workpiece-passing channel;

wherein the dust-scraping member is located between the inlet end of the dust-collecting device and the blow vent of the ion generator, and the dust-scraping member, the inlet end of the dust-collecting device and the blow vent of the ion generator are aligned with each other.

2. The static eliminator with dust removal feature as claimed in claim 1, wherein the static eliminator further comprises at least one ion-transmitting pipe, which is aligned with the blow vent of the ion generator and the dust-scraping member.

3. The static eliminator with dust removal feature as claimed in claim 1, wherein the ion generator can generate negative ions.

4. The static eliminator with dust removal feature as claimed in claim 1, wherein the dust-scraping member with a slice shape has a concave portion corresponding to the workpiece waiting processed, and at least one slot passing through on the concave portion, the blow vent of the ion generator is aligned with the at least one slot.

5. The static eliminator with dust removal feature as claimed in claim 1, wherein the front base has a front opening directly communicating with the front sliding groove and the blow vent of the ion generator, and the rear base has at least one rear hole directly communicating with the rear sliding groove and the inlet end of the dust-collecting device.

6. The static eliminator with dust removal feature as claimed in claim 1, wherein the dust-collecting device comprises a vacuum generator generating vacuum and a dust-collecting pocket connected to an exit end of the vacuum generator, and an inlet end of the vacuum generator is used as the inlet end of the dust-collecting device and communicates with the workpiece-passing channel.

* * * * *